US005812110A

United States Patent [19]

Kawasaki et al.

[11] Patent Number: 5,812,110

[45] Date of Patent: Sep. 22, 1998

[54] METHOD OF DISPLAYING KNIT FABRIC AND STITCHED STRUCTURE

[75] Inventors: Hiroaki Kawasaki; Kenshi Murata, both of Kanazawa, Japan

[73] Assignee: Tsudakoma Kogyo Kabushiki Kaisha, Kanazawa, Japan

[21] Appl. No.: 729,526

[22] Filed: Oct. 11, 1996

[30] Foreign Application Priority Data

Oct. 12, 1995 [JP] Japan ..... 7-263869

[51] Int. Cl.[6] ..... G09G 5/00; G06G 19/00; D04B 15/00; D05B 23/00

[52] U.S. Cl. ..... 345/115; 364/470.12; 66/238; 112/470.04

[58] Field of Search ..... 66/136, 75.1, 75.2, 66/232, 238, 231; 112/154, 458, 470.01, 470.04, 470.05, 470.06, 470.09; 364/470.01–470.15, 188; 345/115, 118, 429

[56] References Cited

U.S. PATENT DOCUMENTS

| | | | |
|---|---|---|---|
| 4,608,642 | 8/1986 | Shima | 364/470.12 |
| 4,649,377 | 3/1987 | Urabe | 345/118 |
| 4,816,812 | 3/1989 | Iida | 345/115 |
| 4,856,104 | 8/1989 | Stoll et al. | 364/470.12 |
| 4,984,181 | 1/1991 | Kliman et al. | 345/429 |
| 5,016,183 | 5/1991 | Shyong | 364/470.02 |
| 5,299,514 | 4/1994 | Hayakawa et al. | 112/470.06 |
| 5,388,050 | 2/1995 | Inoue et al. | 364/470.02 |
| 5,410,976 | 5/1995 | Matsubara | 112/470.06 |
| 5,557,527 | 9/1996 | Kotaki et al. | 364/470.02 |

FOREIGN PATENT DOCUMENTS

| | | |
|---|---|---|
| 0 640 707 | 3/1995 | European Pat. Off. . |
| 43 29 875 | 5/1994 | Germany . |
| 3-21661 | 3/1991 | Japan . |
| 5-78960 | 3/1993 | Japan . |
| 5-321101 | 12/1993 | Japan . |

*Primary Examiner*—Jeffery Brier
*Assistant Examiner*—Paul A. Bell
*Attorney, Agent, or Firm*—Oblon, Spivak, McClelland, Maier & Neustadt, P.C.

[57] ABSTRACT

A method of displaying a stitching image particularly for a plating stitch. A screen of a display unit displays a stitch structure including a type of thread for each stitch of a knit fabric. The display area of each stitch is divided into a ground yarn display area and a plating yarn display area based on the type of stitch. The ground yarn is allocated to one of the divided areas while the plating yarn is allocated to the other of the divided areas.

8 Claims, 5 Drawing Sheets

FIG. 4A(II)
FIG. 4A(III)

FIG. 4B(II)
FIG. 4B(III)

FIG. 4C(II)
FIG. 4C(III)
Kij
Ka
Kb
a
b
d

METHOD OF DISPLAYING KNIT FABRIC AND STITCHED STRUCTURE

BACKGROUND OF THE INVENTION

1. Field of the Invention

This invention relates to a method of displaying a knit fabric and stitched structure on a screen in a knit design system. More particularly this invention relates to a displaying method of a knit fabric and its structure which includes a plating stitch such that when planning the knitting process of the knitting machine in accordance with a knit design, one can easily recognize a knitting structure through a displayed image on the screen.

2. Description of the Prior Art

In designing this type of a knit fabric, a so-called knit fabric design system has sprung into wide use, by which a process for designing the knit fabric can be saved by displaying it on the screen of a display unit in various colors and further all the knit control information necessary to knit the designed knit fabric by a knitting machine can be automatically created (for example, Japanese Examined Patent Publication No. 3-21661, Japanese Unexamined Patent Publication No. 5-78960).

This system permits the finished design of a knit fabric to be easily observed by intuition and readily understood in such a manner that a type of a thread such as its color forming each stitch as a unit constituting a knit fabric is classified by a different color and displayed on the screen of a display unit as well as a type of the stitch based on the knitting method of each stitch is displayed on the screen by a different color. For example, when a type of a thread forming each stitch is discriminated and displayed, the designed color arrangement of a knit fabric can be understood at the first glance and when a type of each stitch is classified by color and displayed, how special stitches such as a cable stitch, a stitch with transfer of wales and the like are disposed in a knit fabric can be understood by intuition.

According to the above mentioned prior art, since a type of a thread is displayed by a single color corresponding to the type of the thread in each display area divided for each stitch, when a plating stitch is contained in a knit fabric, there cannot be avoided a problem that the designed color arrangement of the knit fabric cannot be correctly understood. Thus misunderstanding is liable to arise. The plating stitch forms a single stitch using two types of threads, but the designed color arrangement of a knit fabric is completely changed by which of the threads is positioned on the surface of the knit fabric depending upon a type of the stitch. However, the conventional knitting method is disadvantageous in that it cannot exhibit the difference of such a designed color arrangement.

SUMMARY OF THE INVENTION

An object of the present application is to provide a displaying method of knit fabric and stitched structure in a knit fabric design system for allowing the design of a knit fabric to be exhibited in an understandable form especially in a knit fabric containing a plating stitch by classifying the displayed area of each stitch to a ground yarn display area and a plating yarn display area.

A method of displaying a stitched structure of the present invention for achieving the above object when a type of a thread for each stitch of a knit fabric is displayed on the screen of a display unit as a stitched structure classified by a different color, such method comprises the steps of dividing the display area of each stitch into a ground yarn display area and an plating yarn display area as to a stitch composed of a plating stitch, allocating a ground yarn in one of the divided areas, and allocating an plating yarn in the other of the divided areas.

In the above display method, the ground yarn display area can be disposed to the lower portion of the display area and the plating yarn display area can be disposed to the upper portion of the display area.

Further, the area ratio of the respective divided areas can be changed in accordance with a type of a thread of the ground yarn and the plating yarn.

According to the above display method, since the display area of each stitch is divided into the ground yarn display area and the plating yarn display area, the ground yarn corresponding to the first side thread is displayed in one of the areas and the plating yarn is displayed in the other one of the areas. Thus the actual colored design of the knit fabric can be expressed with respect to the plating stitch taking the color of the plating yarn into consideration so that it can be easily understood.

It should be noted that the ground yarn referred to here is a thread to be fed through a preceding yarn carrier against two types of threads which form a single stitch and the plating yarn is a thread to be fed through a yarn carrier following the above yarn carrier feeding the ground yarn. Further, the corresponding relationship between the ground yarn, the plating yarn and the ground yarn display area and the plating yarn display area is such that when a plating stitch is knitted by the needle of a front bed, the ground yarn is caused to correspond to the ground yarn display area and the plating yarn is caused to correspond to the plating yarn display area. Whereas when the plating stitch is formed by the needle of a rear bed, they are caused to correspond to each other in a reverse fashion. However, it is supposed that a knitting machine at this case is a V-bed type flat knitting machine having a plurality of independently operable yarn carriers and front and rear needle beds.

It is preferable that the display area of each stitch is formed to a rectangle generally having a long side in the course direction and a short side in the wale direction and the plating yarn display area is formed by partitioning a portion of the display area by a straight line or a curved line and the remaining area is allocated to the ground yarn display area. At the time, the ground yarn display area and the plating yarn display area may be discriminated by displaying one or a plurality of figures in the ground yarn display area and the plating yarn display area, respectively, and changing a type of the figures in addition to that they are displayed by a different color depending upon a type of a thread of the ground yarn and the plating yarn. That is, the discrimination referred to in the present invention includes the discrimination of the display using same area and different figures.

Further, the plating yarn display area may be displayed by a one, two or more of horizontal lines or oblique lines displayed in the display area or a half-tone dot meshing composed of a number of dots entirely or partially dispersed in the display area. At the time, however, all the display areas except the plating yarn display area are caused to correspond to the ground yarn display area.

When the ground yarn display area is disposed in the lower portion of the display area and the plating yarn display area is disposed in the upper portion of the display area, the plating yarn display area is displayed to the upper portion of the ground yarn display area in each display area for each stitch, thus the fact that the ground yarn display area is the base of a color scheme can be properly expressed. However, the upper portion and the lower portion referred to here may arbitrarily classify each display area in such a manner, for example, that the position corresponding to the center of gravity of the ground yarn display area is located in the lower portion of the position corresponding to the center of gravity of the plating yarn display area i.e., the latter is located above the former in addition to the horizontally separated groups between the upper portion and the lower portion.

Further, although the area ratio of the ground yarn display area and the plating yarn display area may be suitably determined previously, it may be automatically or manually set so that it can be arbitrarily changed depending upon a type of a thread of the ground yarn and the plating yarn.

DETAILED DESCRIPTION OF THE PREFERRED EMBODIMENTS

Figure 1:
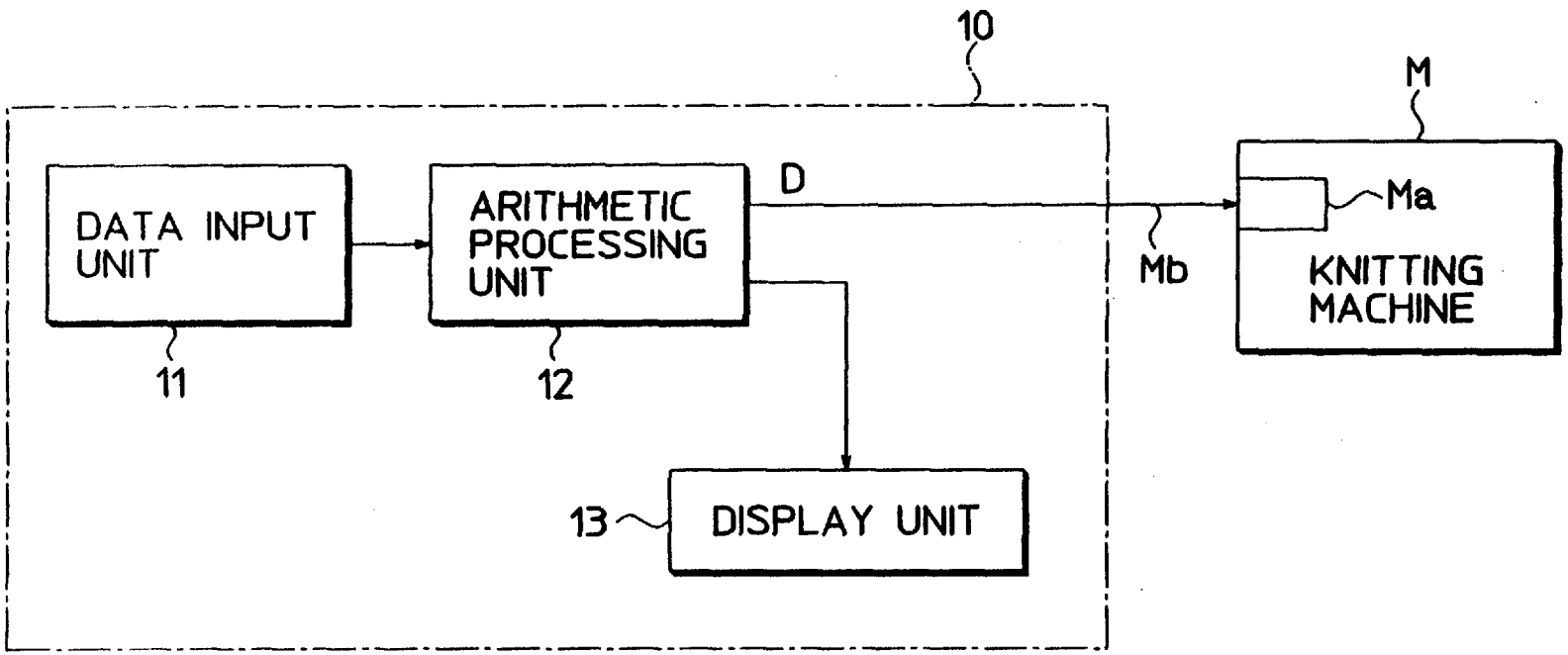
FIG. 1 is a view showing the basic arrangement of an apparatus used to a stitched structure display method of the present invention.

With reference to FIG. 1, a method of displaying the stitched structure of the present invention will be described. In FIG. 1, a knit fabric design system 10 used in the stitched structure display method of the present invention processes data input from a data input unit 11 by an arithmetic processing unit 12 and outputs a processed result to a display unit 13.

More specifically, the data input unit 11 is composed of a single unit or a combination of two or more of, for example, a keyboard, a mouse, a joy stick, a scanner, a digitizer and the like and inputs various types of information as to the design of a knit fabric to the arithmetic processing unit 12. The arithmetic processing unit 12 is composed by the use of a known computer system or a workstation system and displays a type of a thread forming each stitch as a unit for constituting a knit fabric being designed as well as a type of a stitch in each stitch by classifying them by a different color on the screen of the display unit 13.

Further, the arithmetic processing unit 12 can automatically create a series of knitting control information D necessary to knit a knit fabric specified by the stitch images and output it to an external knitting machine M as a whole. Note, the knitting control information D may transmitted on-line as suitable electric signal data through a data bus line Mb for connecting the arithmetic processing unit 12 to the controller Ma of the knitting machine M. Further, it is also possible to record the information D once to a recording media such as a floppy disk or the like, set the recording media to the controller Ma of the knitting machine M and read out the information from the information media by the controller Ma.

A case that a type of a thread for forming each stitch as a unit of the knit fabric is displayed on the display unit 13 as a stitch image K will be described in FIG. 2 as an example. The stitch image K displays m courses of the knit fabric in a longitudinal direction and n wales of the knit fabric in a lateral direction and thus has mn pieces of display areas Kij (i=1, 2 . . . m, j=1, 2 . . . n). Therefore, when each of the display areas Kij is caused to correspond to each stitch of the knit fabric, the stitch image K can display a type of a thread forming each stitch by classifying it by a different color. Note that it is assumed that the arithmetic processing unit 12 can designate any arbitrary portion of the knit fabric and display the stitch image K on the screen of the display unit 13 in a size enlarged or reduced at a desired magnification.

Figure 3:
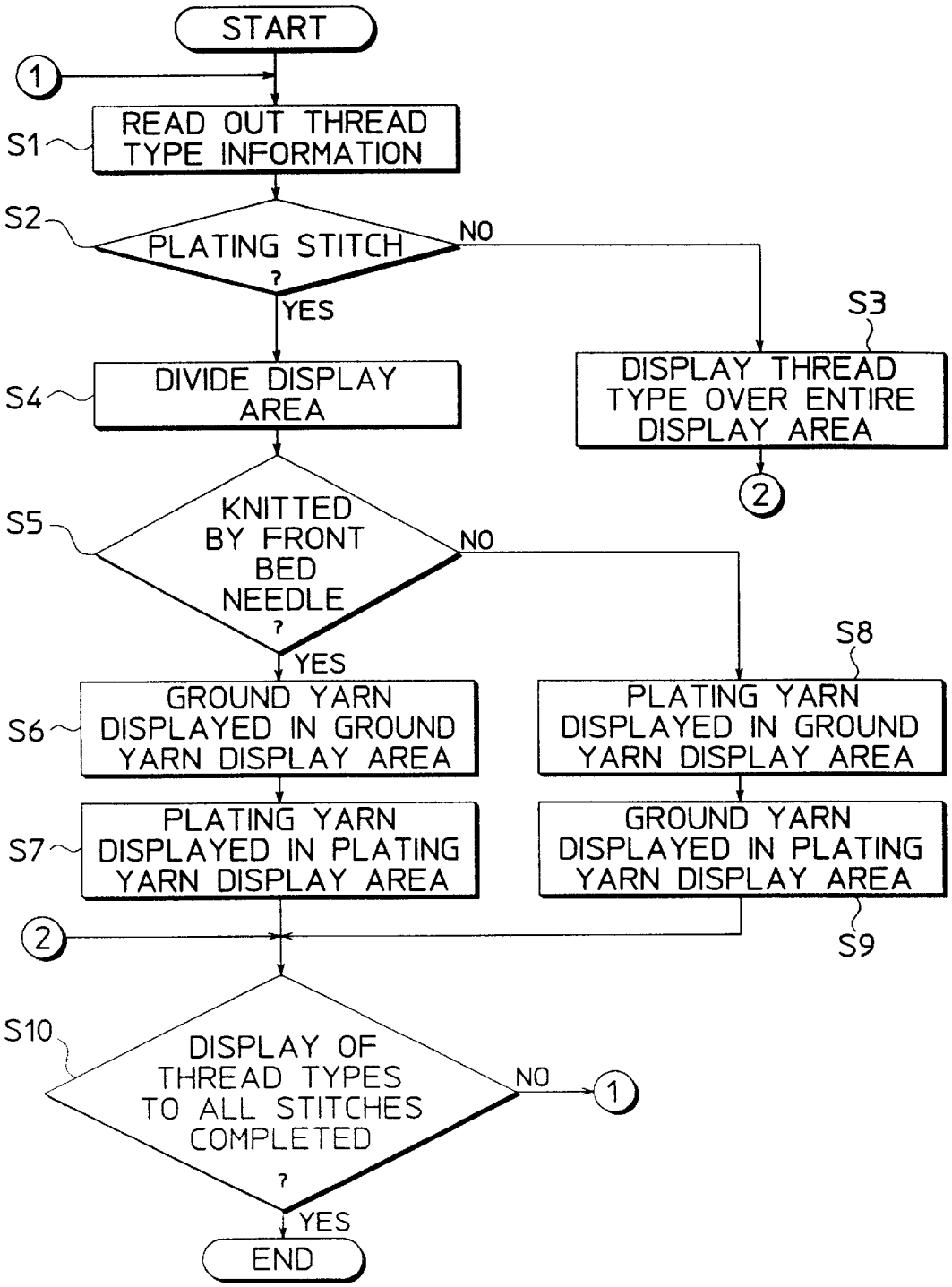
FIG. 3 is a flowchart explaining control operation.

Next, how the arithmetic processing unit 12 executes control operation will be described according to the flowchart of FIG. 3. However, it is assumed that information as to a type of a stitch based on a knitting method of each stitch and a type of a thread for forming each stitch is input and stored to the internal memory of the arithmetic processing unit 12 for each stitch constituting a knit fabric prior to the execution of the program shown in FIG. 3.

First, as to a specific stitch, information as to a type of a thread which forms the stitch is read out from the internal memory (step S1). Next, whether two or more types of threads are designated or not is determined, that is, whether the stitch is a plating stitch or not is determined (step S2). When the stitch is not the plating stitch, a color corresponding to the designated type of the thread (one type) is displayed over the entire display area Kij corresponding to the stitch in the stitch image K (step S3) and the same procedure is continued until the display of the types of the threads for all the stitches is completed (steps S3→S10→S1→S3).

Figures 4A, 4B, 4C:
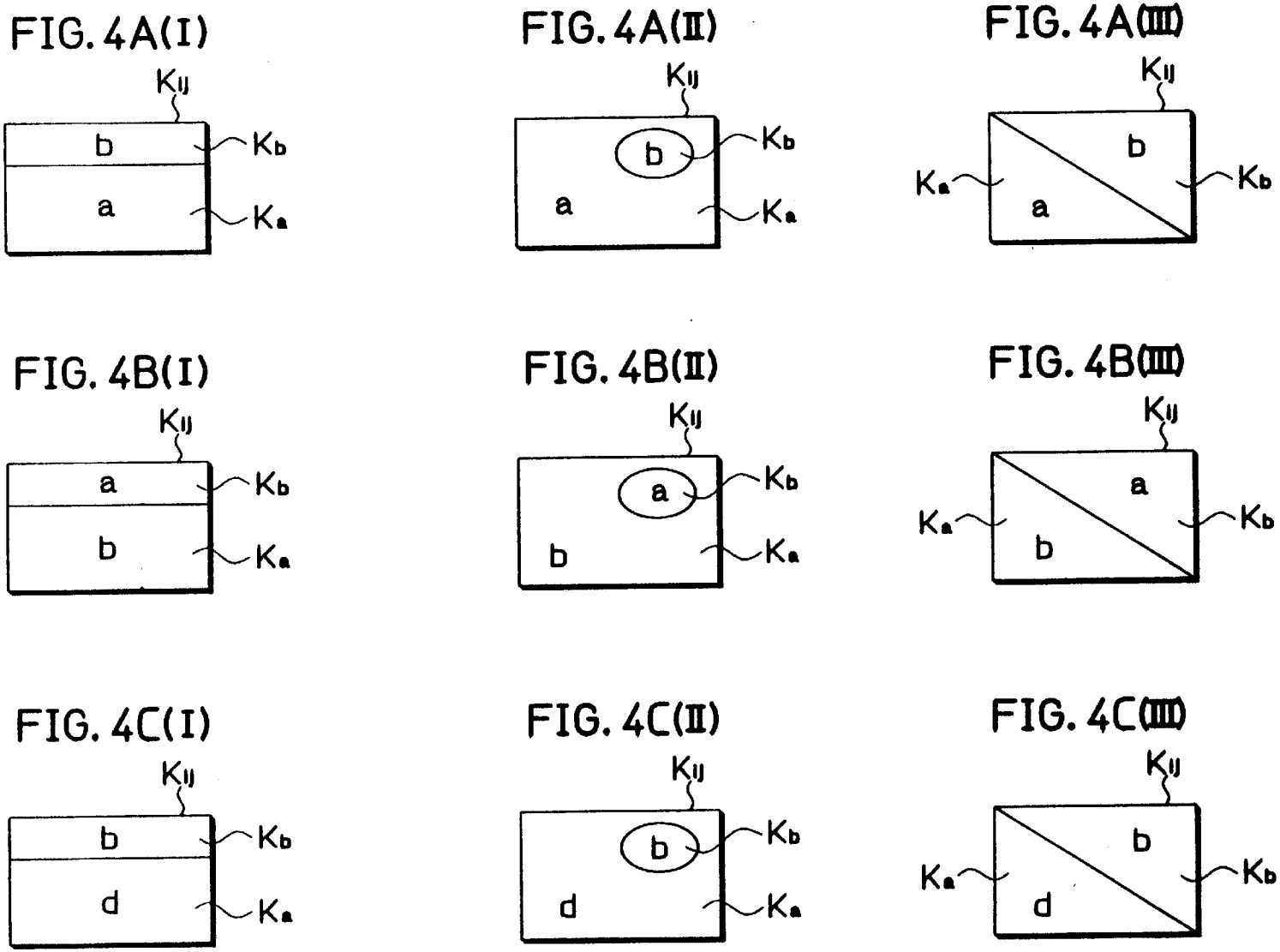
FIG. 4A is a schematic view showing how a displaying area is divided, corresponding to a knit symbol A of FIG. 2.
FIG. 4B is another schematic view showing how a displaying area is divided, corresponding to a knit symbol B of FIG. 2.
FIG. 4C is still another schematic view showing how a displaying area is divided, corresponding to a knit symbol C in FIG. 2.

Whereas, when it is determined at step S2 that two types of threads are designated and the stitch is the plating stitch, the corresponding display area Kij is divided into a ground yarn display area Ka and an plating yarn display area Kb as shown in FIG. 4A (step S4). At the time, however, the display area Kij may be divided into any arbitrary form so long as the position corresponding to the center of gravity of the ground yarn Ka is located to the lower portion of the display area Kij and the position corresponding to the center of gravity of the plating yarn Kb is located to the upper portion of the display area Kij.

Next, at step S5, it is determined whether the stitch is knitted by the needle of a front bed or not. Note, the determination at the time is carried out based on the information as to a type of a stitch based on the knitting method of each stitch.

When the stitch is knitted by the needle of the front bed, the ground yarn a is displayed in correspondence to the ground yarn display area Ka (step 16) and then the plating yarn b is displayed in correspondence to the plating yarn display area Kb (step S7). Whereas, when it is determined that the stitch is knitted by the needle of a rear bed (step S5), the plating yarn b is caused to correspond to the ground yarn display area Ka (step S8) and the ground yarn a is caused to correspond to the plating yarn display area Kb (step S9). That is, when the stitch is knitted by the needle of the front bed, the ground yarn display area Ka in the lower portion of the display area Kij is displayed by the color corresponding to the ground yarn a and the plating yarn display area Kb in the upper portion is displayed by the color corresponding to the plating yarn b.

Whereas, when the stitch is knitted by the needle of the rear bed, the above display is reversed in the display pattern opposite to that shown in FIG. 4A(I)–(III) and FIG. 4B(I)–(III). Next, the process goes to step S10 to check whether the display of the types of the threads as to all the stitches is completed and the similar procedure is repeated until the display is completed (steps S10→S1→S2→S10).

Figure 2:
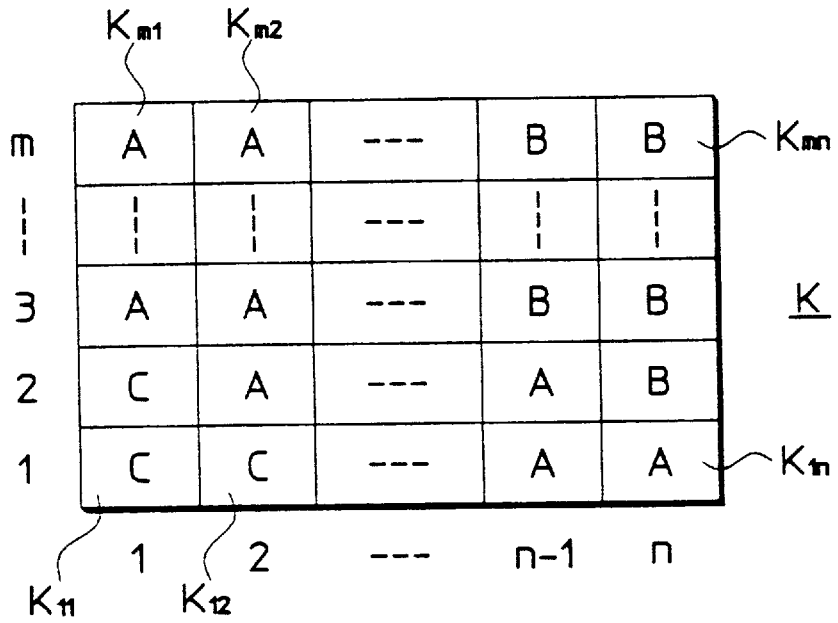
FIG. 2 is a schematic view showing a stitch image of displayed on a display unit.

For example, a stitch in which the ground yarn "a" and the plating yarn "b" are knitted to a plating stitch by the needle of the front bed is denoted by a symbol A, a stitch in which the ground yarn a and the plating yarn b are knitted by the needle of the rear bed is denoted by a symbol B and a stitch in which a ground yarn "b" and an plating yarn "d" are knitted to a plating stitch by the needle of the rear bed is denoted by a symbol C in FIG. 2, the respective display areas Kij shown by the symbols A, B, C in the drawing can be expressed by the display areas Kij shown in FIGS. 4A(I–III), 4B(I–III),and 4C(I–III) respectively. That is, the stitch image K at the time can properly express the colored design of the knit fabric where the plating stitch exists.

In FIG. 4A to FIG. 4C, it is preferable that the area ratio of the ground yarn display area Ka and the plating yarn display area Kb obtained by dividing the display area Kij is set to the ratio of about 1:1 to 10:1 as shown in (I)–(III) of the respective drawings FIGS. 4A–4C. In particular, when the display area Kij is horizontally divided ((I) in the respective drawings FIGS. 4A–4C), the division of the area ratio thereof to 2:1 permits a visually excellent recognizing property.

Further, the plating yarn display area Kb may be expressed by one, two or more of simple horizontal lines or oblique lines or by a half-tone dot meshing composed of a number of dots dispersed in the display area Kij. Further, when a plating stitch is knitted by the single ground yarn a and the two or more plating yarns b1, b2 . . . by the employment of three or more yarn carriers, it is preferable to display the plating yarn display area Kb by further classifying it to two or more plating yarn display areas Kb1, Kb2 . . . by a different color.

Figure 5:
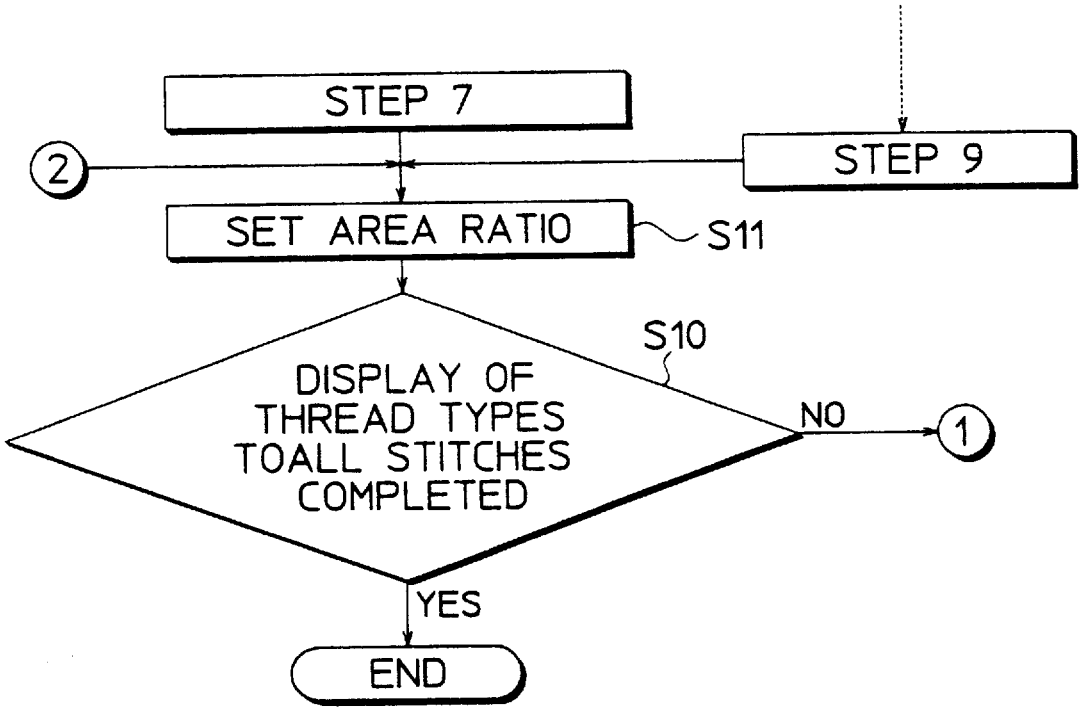
FIG. 5 is a partial flowchart showing the changed portion of the control operation.

Note that how the ground yarn a and the plating yarn b appear on the knit fabric may be greatly changed depending upon the thickness, bulkiness and the like of the ground yarn a and the plating yarn b to be used in addition to a type of each stitch. To cope with this problem, programming may be made so as to set the area ratio of the ground yarn display area Ka and the plating yarn display area Kb in each display area Kij variable in accordance with a type of a thread of the ground yarn a and the plating yarn b as shown in the partial flowchart of FIG. 5. However, FIG. 5 is prepared by adding the processing of step S11 in front of step S10 of FIG. 3 and this step (processing at step S11) shows that a predetermined area ratio can be automatically set to the ground yarn display area Ka and the plating yarn display area Kb in accordance with a type of a thread of the ground yarn and the plating yarn b. Further, the area ratio of ground yarn display area ka and the plating yarn display area Kb in each display area Kij may be manually set to a suitable area ratio in accordance with a type of a thread of the ground yarn a and the plating yarn b after the completion of a series of the processing in FIG. 3 or FIG. 5 in addition to the automatic setting.

As described above, according to the present invention, since the display area corresponding to the stitch of the stitch image is divided into the ground yarn display area and the plating yarn display area, even if a knit fabric contains a plating stitch, the colored design of the knit fabric in which a type of a thread of an plating yarn is taken into consideration can be properly displayed. As a result, there can be obtained an excellent advantage that the design of the knit fabric can be easily examined and expressed so as to be readily understood by intuition.

Although the present invention has been fully described by way of examples with reference to the accompanied drawings, it is to be understood various changes and modifications will be apparent to those skilled in the art without departing from the spirit and the scope of the invention. Accordingly, the invention should not be limited by the foregoing description but rather should be defined only by the following claims.

What is claimed is:

1. A method of displaying on a screen of a display unit a stitched structure of a knit fabric using a plating yarn in addition to a ground yarn, comprising the steps of:

determining whether a given stitch of the knit fabric includes a plating yarn;

providing a first kind of display area to show a state of the given stitch on the screen, the first kind of display area for the given stitch being divided into a ground yarn display area and a plating yarn display area when the given stitch is determined to include a plating yarn;

allocating one of said divided areas for display of the ground yarn; and allocating the other of said divided areas for display of the plating yarn.

2. A method of displaying a stitched structure according to claim 1, wherein said ground yarn display area is disposed in a lower portion of said first kind of display area and said plating yarn display area is disposed in an upper portion of said first kind of display area.

3. A method of displaying a stitched structure according to claim 1 or claim 2, wherein the area ratio of said respective divided areas is changed in accordance with respective thread types of said ground yarn and said plating yarn.

4. A method of displaying a stitched structure according to claim 1, wherein said ground yarn display area and said plating yarn display area are provided with different representation, respectively.

5. A method of displaying a stitched structure according to claim 4, wherein the representation is defined in color.

6. A method of displaying a stitched structure according to claim 1, further comprising the step of providing a second kind of display area to show a state of the given stitch which is determined not to include a plating yarn, said second kind of display area being entirely provided with a single representation.

7. A method of displaying a stitched structure according to claim 6, wherein the single representation for the second kind of display area is defined in color.

8. A method of displaying a stitched structure according to claim 6, further comprising the step of determining whether the given stitch of the knit fabric which has been determined to include a plating yarn is made by a needle of a front bed or a needle of a rear bed wherein:

said ground yarn display area is allocated for display of the ground yarn and said plating yarn display area is allocated for display of the plating yarn, when the given stitch is determined to be made by a needle of a front bed; and said ground yarn display area is allocated for display of the plating yarn and said plating yarn display area is allocated for display of the ground yarn, when the given stitch is determined to be made by a needle of a rear bed.

* * * * *